United States Patent [19]

Watajima

[11] Patent Number: 4,844,354

[45] Date of Patent: Jul. 4, 1989

[54] CENTRIFUGAL REFINING CRUSHER

[75] Inventor: Teruji Watajima, Takeo, Japan

[73] Assignee: Nakayama Iron Works, Saga, Japan

[21] Appl. No.: 211,427

[22] Filed: Jun. 24, 1988

[30] Foreign Application Priority Data

Mar. 5, 1988 [JP] Japan ..... 63-29450[U]
Mar. 5, 1988 [JP] Japan ..... 63-29451[U]
Mar. 5, 1988 [JP] Japan ..... 63-29452[U]

[51] Int. Cl.[4] ..... B02C 19/00
[52] U.S. Cl. ..... 241/162; 241/275
[58] Field of Search ..... 241/5, 156 R, 162, 275, 241/300

[56] References Cited

U.S. PATENT DOCUMENTS 3,044,720 7/1962 Bridgewater ..... 241/275
3,150,878 9/1964 Adams ..... 241/275
4,651,757 3/1987 Ohyatsu et al. ..... 241/275 X
4,690,338 9/1987 Sayler et al. ..... 241/275 X

*Primary Examiner*—Timothy V. Eley
*Attorney, Agent, or Firm*—Flynn, Thiel, Boutell & Tanis

[57] ABSTRACT

A centrifugal refining crusher for simultaneously crushing and refining feed material in which the feed material such as ores and rocks is thrown out into housing around rotor making use of the centrifugal force created by the rotation of the rotor. A further second rotor is provided under an opening for dropping the feed material formed in between the first housing and the first rotor, a second housing is provided around the second rotor, anvils are provided on the first housing mainly to crush the feed material, and a deadstock portion is formed by the material in the second housing mainly to refine grain shape of the broken feed material.

12 Claims, 4 Drawing Sheets

CENTRIFUGAL REFINING CRUSHER

BACKGROUND OF THE INVENTION

1. Field of the Invention

This invention relates to a centrifugal refining crusher in which ores and rocks are crushed and refined by throwing them out into housings surrounding respective rotors, making use of centrifugal force generated by the rotation of the rotors.

2. Description of the Prior Art

There were available the same kind of centrifugal crushers or refiners such as Japanese Utility model Publication No. 30599/1968 "Balls for Centrifugal Crusher", Japanese Patent Publication No. 33785/1978 "Lump Breaker" and Japanese laid-open Publication No. 216744/1986.

These crushers or refiners according to the prior art intended to crush or refine feed material such as ores and rocks by dropping the feed material essentially onto the center of the rotor rotating at a high speed and throwing out the material into the housing surrounding the rotor taking advantage of the centrifugal force.

However, because all crushers and refiners according to the prior art attempted to crush or refine material only by one-time throwing from the rotor, there was a certain level of limit to the crushing or refining effect, which results in a poor crushing ratio and a low shape factor (degree of roundness by solid content in aggregates).

And the limited crushing and refining effect has brought about another restriction on the size of feed material to be charged.

To solve the above problems, there came in an enhanced type of crushers and refiners such as Utility model Publication No. 8658/1964 "Vertical Impact Crusher", and such "Grain-Shape Refiner" as disclosed respectively in Patent laid-open Publications No. 197158/1987, No. 17159/1987 and No. 197160/1987.

The former "Vertical Impact Crusher" is designed to have two or more times crushing by vertically disposing a plurality of discs with striking plates (equivalent to aforesaid rotor) and a plurality of impact plates (equivalent to aforesaid housing). This repeated crushing can obtain a large crushing ratio, but it has little effect of refining, thus necessitating a further refining by another machine, resulting in a poor productivity.

The latter "Grain-Shape Refiner" intends to make two or more refining by vertically arrangeing two or more stages of combination of rotor and annular grinding chamber (equivalent to aforesaid housing). This repeated refining can improve the shape factor (degree of roundness by solid content in aggregates) representing the degree of roundness, but because the crusher is designed only for refining, feed material must previously be crushed and processed to an acceptable size using another crusher, thus resulting in a poor productivity similar to the former crusher.

And, in the prior art, the first rotor, the second rotor and the rotor boss connecting the both rotors are made inseparably into one piece. As a result, the diameters of both rotors are fixed, thus resulting in a failure to change the peripheral speed of the rotors corresponding to the size, nature, amount and usage of feed material and to change the ratio of the peripheral speeds of the both rotors.

In general, the crushers or refiners according to the prior art develop a large degree of local wear due to the abrasion by the feed material, thus requiring periodic repair or replacement, particularly in the two stage refiner in which excessive local wear is likely to occur because of different wear speeds necessitate the replacement of the total parts.

And again the two stage refiner produces a local heavy wear on the rotor boss due to the abrasion by the feed material flowing from the first housing into the second rotor, thus resulting in a high repair cost—the part can be repaired or strengthened by hard facing—and also eventually in a total replacement because several times of hard facing may cause thermal distortion of the part leading to a failure of rotation.

To protect the inside surface of the rotor from wearing, the "Rotor for Grain Shape Refiner" disclosed in the Patent laid-open Publication No. 241558/1987 is well known to have the lining protection.

The liners on the rotor consist of the bottom liner, side liner and top liner. Horizontal movement of the bottom liner is prevented by providing the bottom liner with the same shape (gradually narrowing outlet) as the bottom face of the outlet path, narrower in width at the outlet side. The horizontal movement of the side liner is prevented by the groove on the backside engaging with the projecting lug vertically provided on the rotor body and by the projecting lug at the lower end inserted in between the side face of the outlet path and the bottom liner. The vertical movement of the bottom liner and the side liner is prevented by the projecting lug at the top end of the side liner inserted in between the top liner attached to the top cover and the side face of the outlet path. Therefore, liner replacement requires the removal of the top cover, thus taking a lot of time and labor.

SUMMARY OF THE INVENTION

The first objective of the invention is to provide a centrifugal refining crusher capable of performing efficient crushing and refining, providing a great crushing ratio and improved shape factor even for the flaky and angular material difficult to refine and an increased production.

The second objective of the invention is to provide a centrifugal refining crusher which permits the peripheral speed of the rotors and the ratio of their peripheral speeds to be changed in accordance with the size, nature, amount and usage of feed material, as well as which needs replacement of only a locally worn part (not the whole parts) when partially worn, thus making repair work more efficient and running cost less.

The third objective of the invention is to provide a centrifugal refining crusher which can expect much more efficient repair work of the rotor boss, thus resulting in much lower running cost.

The fourth objective of the invention is to provide a centrifugal refining crusher which is much easier and quicker in replacing the liners protecting the inside face of the rotors.

The centrifugal refining crusher according to the invention is provided with the first motor and the first housing, further with another (second) rotor under an annular clearance (through which crushed material drops) in between the first rotor and the first housing, and with another (second) housing around aforesaid second rotor. Aforesaid first housing is provided with anvils mainly to crush material, and aforesaid second housing is provided with deadstock portion to refine the shape of grains. Therefore, not only both crushing and refining can be performed with only this one machine, but also a large crushing ratio and an enhanced grain shape acceptance factor (even for material difficult to be shaped up) can be expected, thus resulting in a substantially increased productivity.

Further, when the first and second rotors are installed on the same shaft, and the diameter of the first rotor is made smaller than that of the second rotor so that the peripheral speed of the first rotor is made slower than the one of the second rotor because of the same rpm of the rotors, there is no chance that material is overcrushed, thus eliminating the generation of unnecessary dust powder, which results not only in increased value products but also in a simpler mechanism and a compact machine because of the sole rotor shaft shared with both rotors.

The smaller (50–70) diameter of the first rotor relative to the second rotor not only permits flaky or angular material to be effectively crushed in the first housing as mentioned above, but also prevents aforesaid material from being overcrushed, thus resulting in increased value products.

The smaller diameter of the first rotor relative to the second rotor allows the pitch circle of the anvils to be reduced by that amount of difference, which in turn reduces the throttle ratio (the pitch circle diameter of the anvils/the diameter of the mouth to the second rotor), thus permitting a shorter spacing of the rotors, resulting in a rotor shaft with a smaller diameter—a more compact and less costly machine.

The rotor assembly consists of three blocks, namely the first rotor, the second rotor and the rotor boss connecting the both rotors. These three blocks can be readily assembled and disassembled.

Therefore, replacing the first rotor or the second rotor with another rotor of different diameter not only a peripheral speed of a rotor or a peripheral speed ratio of two rotors to be changed depending on the size, nature, amount and usage of feed material, but also allows repair of a locally worn part by replacing only the worn part (not the whole three parts), thus resulting in efficient repair work and in reduction of running cost.

The rotor boss connecting the both rotors is provided with replaceable protectors therearound. Therefore, the rotor boss portion is protected from wear and only the protector is subjected to wear. The replacement of the protector is done easily and quickly and yet the rotor boss is free from wear for a long time.

In assembling the liners, first of all the side liner is placed against the rotational-direction slant surface of the mounting block formed in between the adjacent outlets and between the bottom plate and the top plate of the rotor so as to prevent outward movement of the side liner along aforesaid slant face. Then, the one-side slant side surfaces of the top liner and the bottom liner both tapered with the narrower end at the rotor periphery are slidably engaged with the grooves formed toward the inner sides of the top plate and the bottom late. At the same time, the other-side slant side surfaces of the top liner and the bottom liner respectively are slidably engaged with the step portions formed along the top and bottom side edges on the inner side of aforesaid side liner. When the crusher starts to rotate, those three types of liners protecting the inner side of the rotor come into tight contact with each other due to the centrifugal force created by the rotation of the rotor. In disassembling the liners, the crusher is brought to a stop. First, driving in the top liner toward the center of the rotor easily releases the fixed side liner. Then, after removing aforesaid side liner, you can also drive in the bottom liner toward the center of the rotor to remove out. Therefore, replacement work of the liners protecting the inside of the rotor is very easy and requires minimum downtime.

BRIEF DESCRIPTION OF THE DRAWINGS

In the accompanying drawings, there are shown illustrative embodiments of the invention from which these and other of its objectives, novel features and advantages will be readily apparent.

In the drawings.

DESCRIPTION OF PREFERRED EMBODIMENTS

Figure 1:
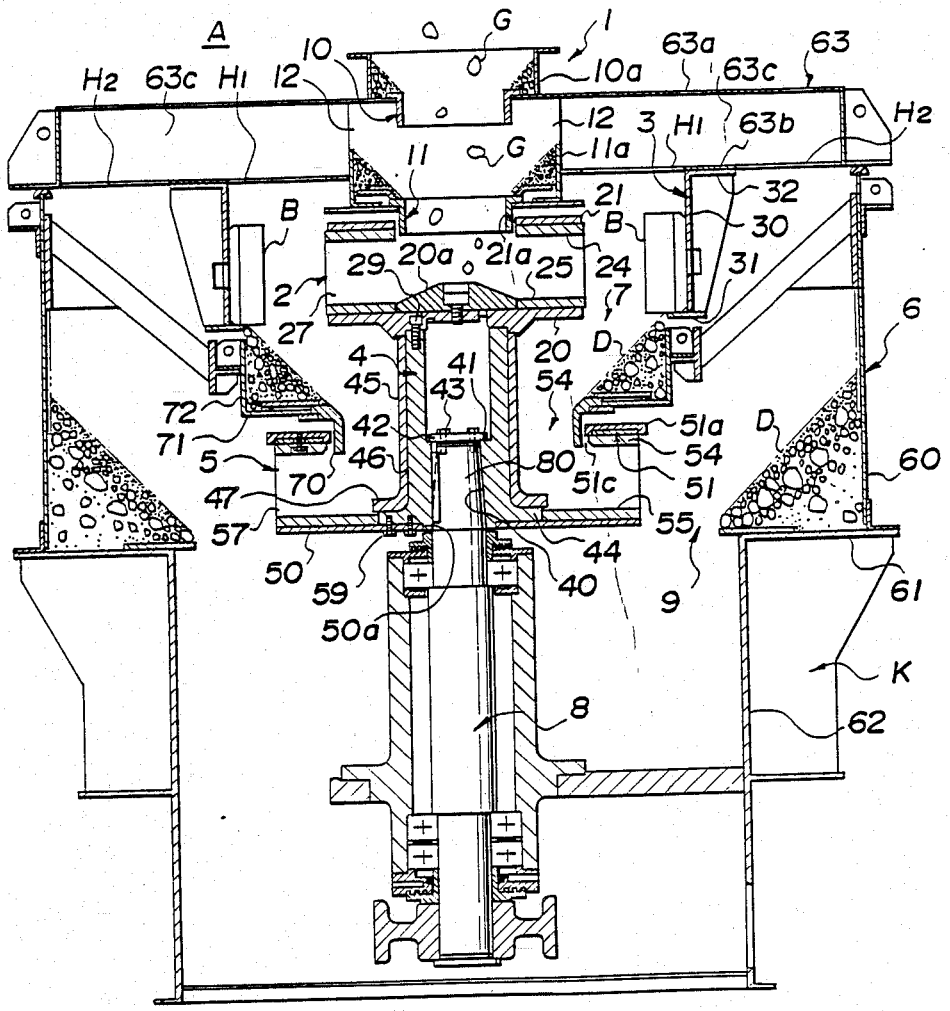
FIG. 1 is a vertical sectional view showing a centrifugal refining crusher according to the invention.
Figure 2:
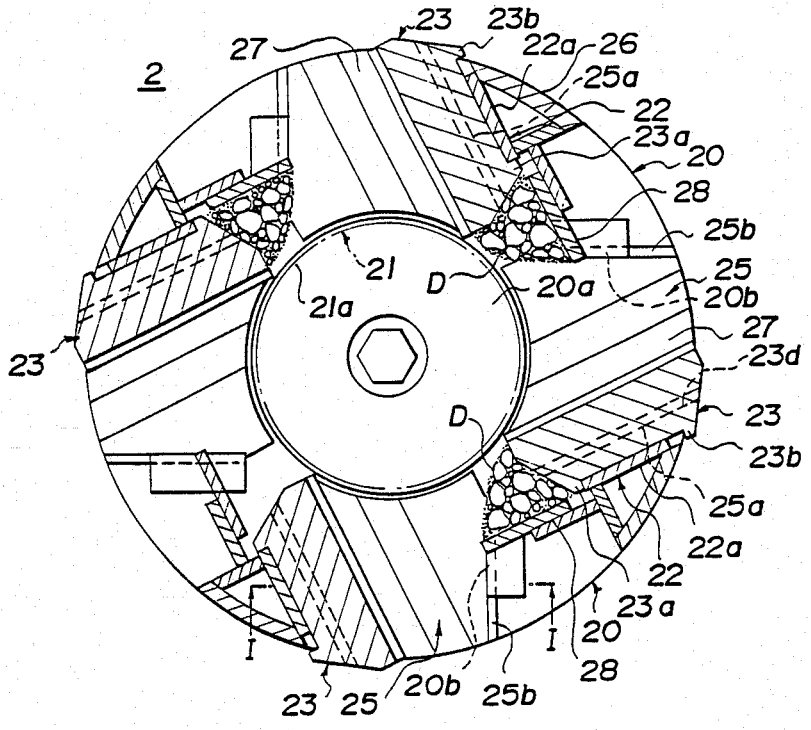
FIG. 2 is a transverse sectional plan view at the first rotor portion.
Figure 3:
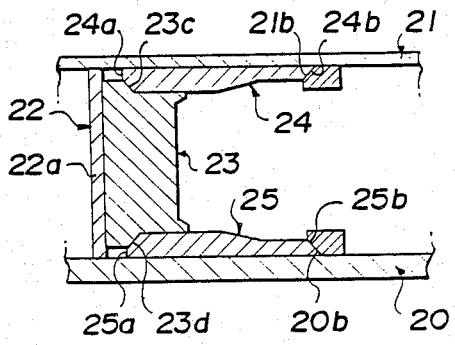
FIG. 3 is a sectional view of the main parts taken along the line I—I of FIG. 2.
Figure 4:
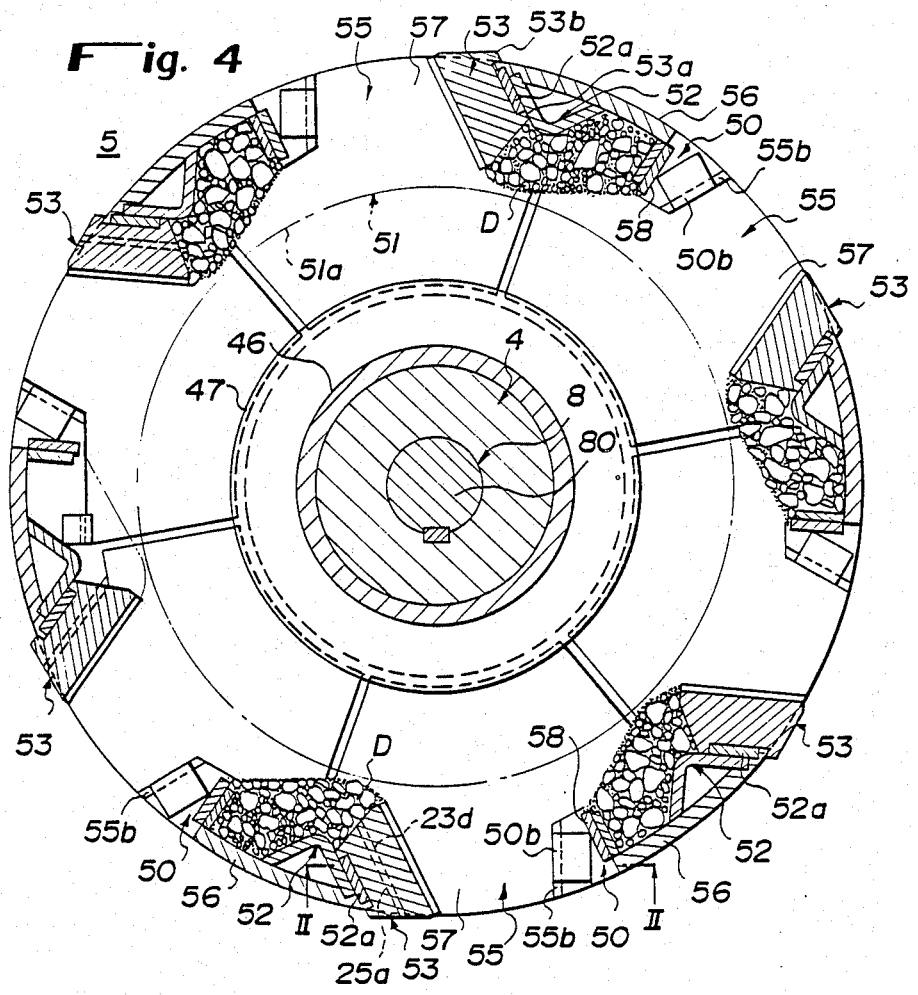
FIG. 4 is a transverse sectional plan view at the second rotor portion.
Figure 5:
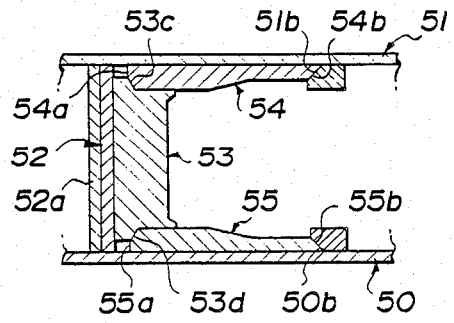
FIG. 5 is a sectional view of the main parts taken along the lines II—II of FIG. 4.
Figure 6:
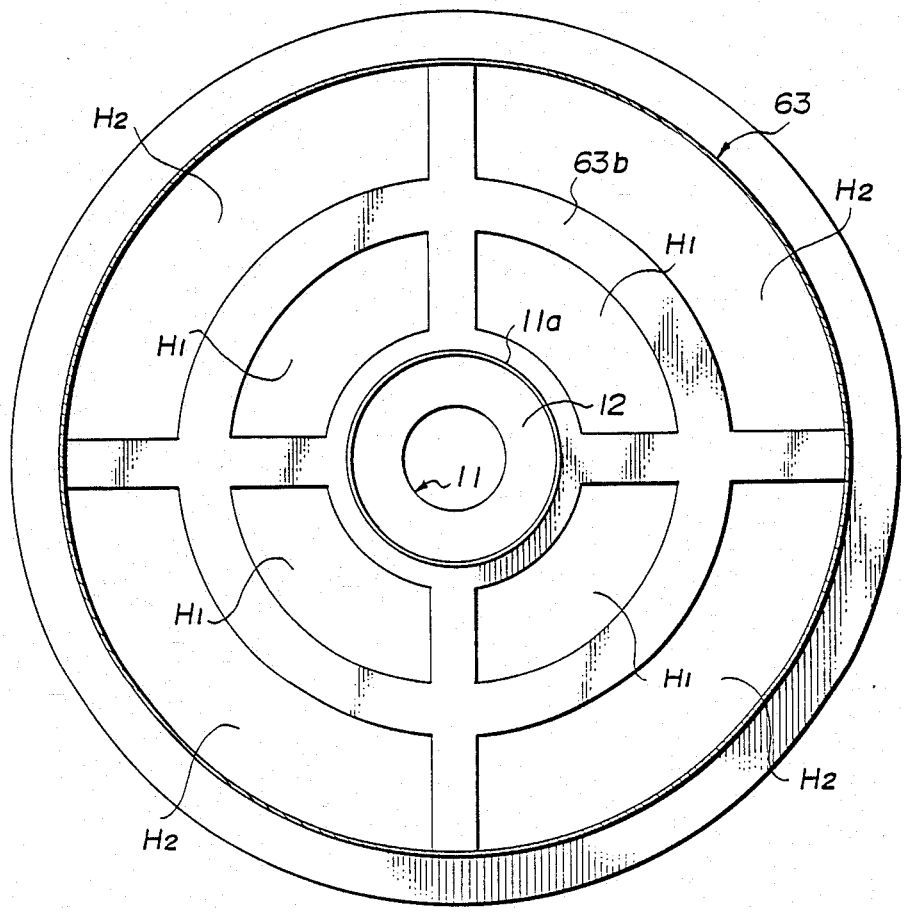
FIG. 6 is a transverse sectional view of the top portion.

First, the configuration of the embodiments according to the invention will be described:

The embodiment of a centrifugal refining crusher A according to the invention, as shown in FIGS. 1–6, consists mainly of a feed opening 1, a first rotor 2, a first housing 3, a rotor boss 4, a second rotor 5 and a second housing 6.

Aforesaid feed opening 1 is a device to drop or supply feed material G essentially into the center of the first rotor 2 rotating at a high speed. The feed opening 1 according to the embodiment consists of a first feed cylinder 10 and a second feed cylinder 11, which respectively are provided with hoppers 10*a*, 11*a* at the upper portion thereof, and there is a large opening 12 in between the hopper 11*a* and the first feed cylinder 10.

Aforesaid first rotor 2 is a rotor which radially throws out the feed material G dropped or supplied from aforesaid feed opening 1 toward the periphery by the centrifugal force created by its high speed rotation. The first rotor 2 according to the embodiment mainly consists of a bottom plate 20, a top plate 21, side plates 23, mounting blocks 22 for the side plates 23, top liners 24 and bottom liners 25.

Aforesaid bottom plate 20 is formed like a disc, on the center of which a replaceable distributor 20*a* is attached as a part of the bottom liner.

Aforesaid top plate 21 is an annular plate, the center of which is an opening 21*a* for charging material. The top plate 21 according to the embodiment is integrally connected to aforesaid bottom plate 20 with four pieces of partial peripheral walls 26 disposed at equal intervals.

Aforesaid mounting block 22 according to the embodiment for the side liner 23 is formed like an angle bar and attached to the inner side of aforesaid peripheral wall 26 disposed in between two adjacent outlets 27 of the first rotor 2.

Aforesaid side liner 23 is a member which constitutes an outlet passage 27 of the first rotor 2 along with the top liner 24 and the bottom liner 25. The side liner 23 according to the embodiment has projecting lugs 23*a* and 23*b* at both ends of the outer side which come into contact with a rotational-direction slant face 22*a* of aforesaid mounting block 22. The projecting lugs 23*a* and 23*b* engage with both ends of the rotational-direction slant face 22*a*, thus preventing the side liner 23, which abuts the slants face 220 from moving outward of the first rotor 2 along the slant face 22*a*.

Aforesaid top liner 24 and bottom liner 25 are both tapered with narrower ends at the periphery of the first rotor 2. Inner edge portions of left and right slant side faces 24*a*, 24*b* and 25*a*, 25*b* are cut slantways.

Aforesaid side liner 23 is slantwise cut along the top and bottom side edge portions of the inner side to provide engaging steps or shoulders 23*c* and 23*d*, which resectively engage slidably with the left slant side face 24*a* and 25*a* of aforesaid respective top liner 24 and bottom liner 25. Aforesaid top plate 21 and bottom plate 20 respectively are provided with v-shape engaging grooves 21*b* and 20*b* thereinside which slidably engage with the right slant side faces 24*b* and 25*b* of the top liner 24 and the bottom liner 25.

In the embodiment, the side liner 23 especially exposed to abrasion and causing rapid local wear is shaped into symmetry in the vertical and horizontal directions, thus permitting a repeated use by turning upside down.

In the drawing, a member 28 is a guide plate to guide the flow of material, and D is a deadstock portion formed by the feed material in between the guide plate 28 and the side liner 23.

Aforesaid first housing 3 is installed mainly to break the feed material G radially thrown out of aforesaid first rotor 2 by the impact force generated when the material hits against the peripheral portion thereof. The first housing 3 according to the embodiment consists of a side wall 30 and an annular bottom plate 31. The side wall 30 is provided with a series of anvils B along the inner surface thereof. An annular drop outlet 7 is formed in between the annular bottom plate 31 and aforesaid first rotor 2.

Aforesaid annular bottom plate 31 is disposed at a slightly lower level than the bottom of the outlet 27 of the first rotor 2.

Aforesaid rotor boss 4 is a member to connect aforesaid first rotor 2 with the second rotor 5. The rotor boss 4 according to the embodiment is formed essentialy like a cylinder, whose lower end is a tapered hole 40. An upper end taper portion 80 of a rotor shaft 8 is fitted into the tapered hole 40 and connected with a key, and further bolts 43 tighten the rotor boss 4 and the rotor shaft 8 for connection through a holding plate 42 mounting on a shoulder 41 formed on the top end of the taper hole 40.

An outward-projecting horizontal 44 of one-piece construction is formed out of the rotor boss 4 at the lower end thereof. An upper cylindrical protector 45 and lower cylindrical protector 46 (both replaceable) are inserted over the outer cylindrical surface of the rotor boss 4. The lower protector 46 is provided with a horizontal projection 47 at the lower end thereof to protect the top surface of the aforesaid flange 44.

Aforesaid second rotor 5 is a rotor to throw out the feed material G which has been broken by the aforesaid first rotor 2 and the first housing 3 and is dropping downward through an annular drop opening 7, by a larger centrifugal force generated by a higher peripheral speed thereof. The second rotor 5 according to the embodiment consists essentially like aforesaid first rotor 2 of a bottom plate 50, a top plate 51 provided with an opening 51*c* in the center thereof, side liners 53, mounting blocks 52 for the side liners 53, top liners 54, bottom liners 55, partial peripheral walls 56, outlets 57 and guide plates 58. Aforesaid bottom plate 50 is provided with an opening 50*a* in the center thereof to pass the rotor shaft 8 therethrough. A replaceable protector 51*a* is covered over the top face of the top plate 51 to protect the top and side surface thereof.

In the drawing, numerals 51*b* and 50*b* are engaging grooves, 52*a* are engaging plates projecting from the mounting blocks 52 along the rotational direction slant face, 53*a* and 53*b* are projecting lugs, 53*c* and 53*d* are engaging shoulders, 54*a* and 54*b* are left and right slant side faces of the top liner 54, as well as 55*a* and 55*b* are left and right slant side faces of the bottom liner 55.

Aforesaid bottom plate 50 is replaceable and fixed to the outward flange 44 at the lower end of aforesaid rotor boss 4 by tightening bolts 59 from under.

In the drawing, numeral 70 is a guide ring to guide the material G dropping through aforesaid annular opening 7, into the opening 51*c* in the top plate 51. A peripheral wall 72 and a bottom plate 71 connected to the periphery of the guide ring 70 form a deadstock portion by feed material D.

Aforesaid first rotor 2 is replaceable and connected to the annular top end face of aforesaid boss 4 by tightening essentially the center part of the bottom plate 20 using bolts 29.

Aforesaid second housing 6 is designed mainly to refine the material G by the impact force generated by receiving the material G radially thrown out from aforesaid second rotor 5 at the periphery portion thereof.

The second housing 6 according to the embodiment consists of a peripheral side wall 60 and an annular bottom plate 61, which also make a deadstock portion D by feed material.

Aforesaid bottom plate 61 is disposed at a slightly lower level than the lower end of the outlet 57 in the second rotor 5. An annular drop opening 9 is formed in between the inner side end of the bottom plate 61 and the second rotor 5.

According to the embodiment, the diameter of the first rotor 2 is designed smaller (some 70%) than that of the second rotor 5, which makes the peripheral speed of the first rotor 2 slower than that of the second rotor 5. Assuming both speeds are equal to each other, feed material may be overbroken into undesirable dust, thus resulting in lowered production of value products. Therefore, the diameter of the first rotor 2 is reduced relative to that of the second rotor 5 to suppress the peripheral speed of the first rotor 2.

The ratio of diameters of first rotor and second rotor over 70% tends to be overcrushing, while the ratio under 50% is likely to be poor crushing. Therefore the ratio between 50–70% is advisable.

According to the embodiment, aforesaid peripheral side wall 60, the bottom plate 61, a base cylinder 62 connected to the bottom plate 61, and a top cover 63 mounted on the top opening of aforesaid side wall 60 constitute an outer casing K. The first feed cylinder 10 of aforesaid feed opening 1 is inserted into the center of an outer plate 63*a*, while the second feed cylinder 11 is inserted into the center of an inner plate 63*b*.

An annular top plate 32 constituting aforesaid first housing 3 is fixed to aforesaid inner plate 63*b*, which permits aforesaid feed opening 1 and the first housing 3 to be removed integrally with the top cover 63.

A number of draft ports H1 and H2 are opened substantially at equal intervals over the periphery of the inner plate 63*b* or the top plate of aforesaid first and second housings 3 and 6.

Next, the operation of the embodiment will be described:

Such being the configuration, the centrifugal refining crusher A according to the invention supplies material G fed into the feed opening 1 through the first and second feed cylinders 10 and 11 onto the center of the first rotor 2, and then a centrifugal force created by the high speed rotation of the first rotor 2 and the side liners 23 throws out the feed material G radially toward the periphery of the rotor 2 through the outlets 27.

The thrown material G then strikes a series of anvils B attached inside the side wall 30 of the first housing 3. The adequate striking force given by the anvils B and a force generated by collision with each other of material effectively break flaky and angular material into finer pieces.

Guided by the deadstock D and the guide ring 70, the material G broken as such drops into the opening 51*c* of the second rotor 5 through the annular opening 7, while being thrown out through the second rotor 5 by the centrifugal force thereof.

An especially larger size of the thrown material G is further broken into smaller size by impact forces generated when the material G collides with the slant surface of of the deadstock D formed in the second housing 6 by the deposit or build-up of material G. When each grain of the material G collides with an other, the sharp edge of each grain is rounded by a complicated action ofsurface collision with deposited grains as they roll down along the slant surface of the deadstock D the grain, thus being refined into cubical or round shape and finally thrown out to the outside through the annular discharge opening 9.

Therefore, this one crusher is capable of efficient crushing and refining of material providing a greater crushing ratio and provides improved shape factor even for flaky and angular material difficult to refine, and a substantial enhancement in productivity.

The air, blown out with the material G through the outlets 27 and 57 by the centrifugal blast action generated by the rotation of the first and second rotors 2 and 5, is vertically dispersed by the vertical face of the anvils B in the first housing 3, but is guided upwards in the second housing 6 by the slant face of the deadstock D to be smoothly ejected into the air passage 63*c* through the draft openings H1 and H2 opened in the periphery of the top covers. On the other hand, suction forces generated at the material inlets of the first and second rotors 2 and 5 by themselves form an air circulation passage through which the air is drawn again into the first rotor 2 via the opening 12 formed between the hopper 11*a* of the second feed cylinder 11 and the first feed cylinder 10, and the inside of the second feed cylinder 11. Therefore, the crusher with two stages of rotors according to the invention can completely prevent the ejection of dust to outside.

Further, the air that is uniformly blow up over the periphery of the housing as mentioned above allows the crushed material G to stay longer around the deadstock D which substantially improves the refining of the material G.

Next, the first rotor 2 can be replaced by loosening the bolts 29 after removing aforesaid top plate 63 and the distributor 20*a* of the first rotor 2. The removal of the first rotor 2 allows for the replacement of the upper protector 45 and the lower protector 46.

Removing the guide ring 70 permits the replacement of the protector 51*a*, and loosening the bolts 43 allows the rotor boss 4 to be removed together with the second rotor 5. Loosening the bolts 59 permits the replacement of the second rotor 5.

As a result, change of peripheral speeds of rotors and of peripheral speed ratio of rotors can be easily made in accordance with the size, nature, amount and usage of feed material. Repair of local wear in the crusher according to the invention can eliminate the need for replacing the total parts in the prior art, thus resulting in efficient repair work and reduced running cost.

Next, to install the liners to the first rotor 2, first, insert the bottom liner(s) 25 along the engaging groove(s) 20*b* from the center of the first rotor 2. Engage the projecting lugs 23*a* and 23*b* of side liners 23 with the both ends of the rotation-direction slant face 22*a* of the mounting block 22. After engaging the lower engaging slant face or shoulder 23*d* of the side liner 23 against the left-side slant face 25*a* of aforesaid lower liner 25, insert the top liner 24 from the center of the first rotor 2 while sliding the left and right slant faces 24*a* and 24*b* against the top engaging slant face or shoulder, 23*c* of the side liner 23 and the engaging groove 21*b*, thus completing the installation work of all liners.

In this condition, when the first rotor 2 starts to rotate at a high speed, the centrifugal force created by the rotation of the first rotor 2 exerts a force to push out the top and bottom liners 24 and 25 toward the periphery of the first rotor 2. As a result, the top and bottom liners 24 and 25 are respectively wedged and securely fixed at the left and right slant faces 24*a* and 24*b*, and 25*a* and 25*b* respectively in between the engaging slant face, or shoulder 23*c* and the engaging groove 21*b*, and the engaging slant face or shoulder 23*d* and the engaging groove 20*b*. Also, the left slant faces 24*a* and 25*a* of the top and bottom liners 24 and 25 strongly press the side liner 23 against the rotation-direction slant face 22*a* of the mounting block 22, thus maintaining the engagement of the projecting lugs 23*a* and 23*b* (especially 23*a*) of the side liner 23 with the slant face 22*a*, which permits a secure connection of the three liners only with centrifugal force.

On the other hand, to replace the liners. First, drive in the top liner 24 toward the center of the first rotor 2, which releases the locking of the side liner 23. Next, after removing the side liner 23, the bottom liner 25 can be removed to the direction of the center of the first rotor 2, thus permitting an easy and quick replacement of the liners.

It will be clear to those skilled in the art that various changes may be made in the invention without departing from the spirit and scope thereof and therefore the invention is not limited by that which is shown in the drawings and described in the specification but only as indicated in the appended claims.

For instance, in the embodiments according to the invention, both of the first and second rotors are of the same type, but different types of rotors may be combined.

Further, as means for preventing the side liners from moving outwards along the slant face of the mounting block, projecting lugs are provided at the both ends of side liners to engage with the end faces of the mounting block, but a projecting lug formed on the side liner may be engaged in an engaging hole drilled in the slant surface of the mounting block.

What is claimed is:

1. A centrifugal refining crusher for crushing or refining feed material, comprising:

a first rotor having a center portion and being rotatable, a first housing surrounding the periphery of said first rotor, said first rotor including centrifugal means for throwing feed material radially out from said center portion into said first housing using centrifugal force, supply means for dropping feed material essentially onto said center portion of said first rotor, means provided on said first housing for crushing feed material, opening means for dropping feed material formed between said first housing and said first rotor, a second rotor provided under said opening means and being rotatable, a second housing provided around the periphery of said second rotor, said first and second rotors respectively including a disk-like bottom plate, an annular top plate, a plurality of partial peripheral walls disposed at equal intervals around said rotor periphery, said peripheral walls defining outlets therebetween, a plurality of mounting blocks attached to the inner side of said peripheral walls, said mounting blocks having a slant face oriented toward a direction of rotation of said rotor, and means for protecting the inside of said rotors, said protecting means including a plurality of top and bottom liners, a plurality of side liners abutting said slant faces and engaged between said bottom and top plates, and means for preventing outward movement of said side liners along said mounting block slant faces, said preventing means including said top and bottom plates each having engaging grooves formed thereinside, said side liners having engaging shoulders formed along upper and lower edge portions of an inner side thereof, said top and bottom liners each having left and right slant side faces, said top liners having said left and right slant side faces slidably engaged with said upper engaging shoulders of said side liners and said engaging grooves of said top plate, respectively, said bottom liners having said left and right slant side faces slidably engaged with said lower engaging shoulders of said side liners and said engaging grooves of said bottom plate, respectively, said top and bottom liners being tapered with narrower ends at the periphery of said rotors, and said top, bottom and side liners being lockable together by centrifugal force.

2. A centrifugal refining crusher as claimed in claim 1, including said first rotor and said second rotor sharing the same rotor shaft, and means for moving said rotors at different peripheral speeds, the first being slower than the second, said moving means including said rotors having different diameters.

3. A centrifugal refining crusher as claimed in claim 2, wherein the diameter of said first rotor is 50–70% of that of said second rotor.

4. A centrifugal refining crusher as claimed in claim 1, including a rotor boss connecting said first and second rotors, and wherein said first rotor, said second rotor and said rotor boss form a rotor assembly.

5. A centrifugal refining crusher as claimed in claim 4, wherein replaceable protectors are provided around said rotor boss connecting both said rotors.

6. A centrifugal refining crusher, comprising:

first rotor means for throwing feed material radially outward by the centrifugal force created by its rotation, a first housing surrounding the periphery of said first rotor means, means provided on said first housing to crush feed material, second rotor means, larger than said first rotor means, further provided under an opening formed between said first rotor means and said first housing to throw feed material radially outward by the centrifugal force of its rotation, first deadstock meand provided under said opening formed between said first rotor means and said first housing for guiding and correcting size and shape of materials dropping through said opening into a central opening of said second rotor means, said first deadstock means including first means for constructing slanted material deposits, a second housing surrounding the periphery of said second rotor means, and second deadstock means provided on said second housing for guiding materials into a drop opening formed between said second rotor means and said second deadstock means and correcting size and shape of materials, said second deadstock means including second means for constructing slanted material deposits.

7. A centrifugal refining crusher as claimed in claim 6, wherein said first rotor means and said second rotor means respectively include a top plate, a bottom plate, and mounting blocks provided between said top plate and said bottom plate, said mounting blocks having a slant face oriented toward a direction of rotation of said rotor means, and means for protecting the inside of said rotor means;

said protecting means including a plurality of top and bottom liners, a plurality of side liners abutting said slant faces and engaged between said bottom and top plates, and means for preventing outward movement of said side liners along said mounting block slant faces;

said preventing means including said top and bottom plates each having engaging grooves formed thereinside, said side liners having engaged shoulders formed along upper and lower edge portions of an inner side thereof, said top and bottom liners each having left and right slant side faces, said top liners having said left and right slant side faces slidably engaged with said upper engaging shoulders of said side liners and said engaging grooves of said top plate, respectively, said bottom liners having said left and right slant side faces slidably engaged with said lower engaging shoulders of said side liners and said engaging grooves of said bottom plate, respectively, said top and bottom liners being tapered with narrower ends at the periphery of said rotor means, and said top, bottom and side liners being lockable together by centrifugal force.

8. A centrifugal refining crusher, comprising:

first rotor means for expelling feed material from a first region into a second region, said first region being within the periphery of said first rotor means, said second region being horizontally beyond the periphery of said first rotor means;

a first housing in said second region and surrounding the periphery of said first rotor means, said first housing including rigid means for crushing feed material colliding therewith;

second rotor means disposed below said first rotor means for expelling feed material from a third region into a fourth region, said third region being within the periphery of said second rotor means, said fourth region being horizontally beyond the periphery of said second rotor means;

a second housing in said fourth region and surrounding the periphery of said second rotor means; and guide means for guiding feed material from said second region to said third region, said guide means including first construction means for constructing a pile of feed material sloping downwardly from just below said second region to just above said third region.

9. A centrifugal refining crusher according to claim 8, including second construction means for constructing a pile of feed material in said fourth region sloping upwardly away from said second rotor means.

10. A centrifugal refining crusher according to claim 9, including said second construction means being cooperable with said second rotor means for crushing feed material by causing feed material expelled by said second rotor means to collide with feed material accumulated by said second construction means.

11. A centrifugal refining crusher according to claim 10, including said second construction means being cooperable with said second rotor means for refining feed material by causing feed material expelled by said second rotor means to roll down along feed material accumulated by said second construction means.

12. A centrifugal refining crusher according to claim 8, including means for preventing ejection of dust outside the crusher.

* * * * *